US008662700B2

(12) United States Patent
O'Sullivan

(10) Patent No.: US 8,662,700 B2
(45) Date of Patent: Mar. 4, 2014

(54) FLASHLIGHT WITH MOTORIZED DIRECTIONAL LIGHTHEAD FOR LIGHTBEAM PLACEMENT

(76) Inventor: Paul O'Sullivan, Hartsdale, NY (US)

( * ) Notice: Subject to any disclaimer, the term of this patent is extended or adjusted under 35 U.S.C. 154(b) by 614 days.

(21) Appl. No.: 12/796,706

(22) Filed: Jun. 9, 2010

(65) Prior Publication Data

US 2010/0309656 A1 Dec. 9, 2010

Related U.S. Application Data

(60) Provisional application No. 61/268,155, filed on Jun. 9, 2009.

(51) Int. Cl.
*F21L 4/00* (2006.01)

(52) U.S. Cl.
USPC ..... 362/197

(58) Field of Classification Search
USPC ..... 362/197, 287, 297, 428
See application file for complete search history.

(56) References Cited

U.S. PATENT DOCUMENTS

| | | | | |
|---|---|---|---|---|
| 5,595,436 | A | 1/1997 | Way, Jr. | |
| 5,681,106 | A | 10/1997 | Coultas | |
| 5,707,139 | A | 1/1998 | Haitz | |
| 5,720,542 | A | 2/1998 | Birge, Jr. | |
| 5,893,630 | A | 4/1999 | Mosquera | |
| 6,158,876 | A | 12/2000 | Birdwell | |
| 6,318,879 | B1 | 11/2001 | Huang | |
| 6,371,635 | B2 | 4/2002 | Ott | |
| 6,447,143 | B2 | 9/2002 | Krietzman | |
| 6,794,830 | B2 | 9/2004 | Lansing | |
| 6,817,730 | B2 | 11/2004 | Sharrah | |
| 6,877,702 | B1 | 4/2005 | Diggle | |
| 7,055,983 | B1 | 6/2006 | Baker | |
| 2009/0196016 | A1 * | 8/2009 | Massara et al. | 362/86 |
| 2010/0259945 | A1 * | 10/2010 | Chiu | 362/428 |

* cited by examiner

*Primary Examiner* — Anh Mai
*Assistant Examiner* — Brenitra M Lee
(74) *Attorney, Agent, or Firm* — Symbus Law Group, LLC; Clifford D. Hyra

(57) ABSTRACT

A flashlight has a casing, designed for hand-carrying, housing a motor connected to a lighthead by a mechanical linkage, one or more power sources configured to supply power to the lighthead and to the motor, and a user-operable control device configured to control a motion of the lighthead. The lighthead contains or is attached to a lighting element, the user-operable control device includes a switching assembly, and the lighthead is rotatable about an axis. The mechanical linkage is configured to translate a motive force from the motor into motion of the lighthead. Operation of the switching device rotates the lighthead, easily adjusting the direction of the light beam emitted by the flashlight at the touch of a finger.

24 Claims, 5 Drawing Sheets

FLASHLIGHT WITH MOTORIZED DIRECTIONAL LIGHTHEAD FOR LIGHTBEAM PLACEMENT

This application claims the benefit of U.S. Provisional Application No. 61/268,155, filed Jun. 9, 2009, which is hereby incorporated by reference in its entirety.

BACKGROUND

The flashlight has many variations currently available. Many of these different varieties try to accomplish the goal of directing the beam of light. However, ultimately to adjust the beam direction at least one hand is required and the unit must be supported or otherwise secured to insure the assembly moves only where the user directs the unit. The user must use two hands or otherwise support the unit with his person in order to accomplish redirection of the beam. Two hands are required when the assembly is held with one hand. U.S. Pat. No. 6,817,730 (2004) to Sharrah, et al provides for a flashlight where the reflector is rotated to direct the light beam. It requires being secured to a fixed surface and the rotating elements require a hand to properly aim the units.

The commercial marketplace has many examples of flashlights with directional heads. However, the flashlights must be supported by the user in order to redirect the beam of light. For example, units are available which attach to the head via straps. An example of this is the Pelican Model 2250C or the Energizer HDL33AINE. These are typical of many examples of hands free operation. The unit attaches to the head with a strap or to the users body with a clip. The lighting element is attached to the strap or the clip. The beam can be repositioned by the user shifting his head or using one hand to adjust the element strapped or clipped to the head or body. However, these units require the user to use one hand to adjust the direction of the head assembly and additionally provide support for the unit via their person lest the assembly move while the adjustment is being made. Depending on the sturdiness of the attachment, the user will have to be careful lest he accidentally remove the unit from his person as it is adjusted, which may require both hands to prevent this. Furthermore, the lightbeam follows the user's head which may prevent effective illumination of the work area.

Another example of a user adjusted unit is the DeWalt DW 918 which has a flexible neck. The user can adjust the direction of the light beam via adjustment of the head mounted at the end of the flexible neck. However, as with earlier examples of prior art the user generally has to use two hands, one to secure the base as the other hand adjusts the lighthead assembly to ensure that the base does not move as the lighthead is adjusted.

Other examples of flashlights for one handed operation or handless operation require a separate frame. An example of this is the Nite Ize model NFF-07-AA which holds a common aluminum bodied penlight. The light body is mounted in the frame. However, this frame only directs light in a static direction. Any adjustment of the beam direction requires the user to use two hands to insure the adjustment is made correctly and accurately to the beam direction.

Finally, there are many examples of hand-held flashlights with adjustable heads. These as with the earlier examples require at least one hand to adjust the beam and usually both to adjust the direction of the beam. This type of adjustable head flashlight requires one hand to secure the unit while the other adjusts the movable head and thus the beam direction. Even if the unit is capable of freestanding as with the flexible neck DeWalt unit, generally two hands are required to insure that the unit is not tipped over or otherwise inaccurately adjusted as the operator redirects the lighthead and thus the beam of light. The market place is full of examples of this type of light. The Pivot Lantern manufactured by Innovage Outdoor (Patent pending 200530058960.5) is one example of many in the marketplace.

Needs exist for improved flashlights that allow for adjustment of the light beam with minimal physical contact and force.

SUMMARY

It is to be understood that both the following summary and the detailed description are exemplary and explanatory and are intended to provide further explanation of the invention as claimed. Neither the summary nor the description that follows in intended to define or limit the scope of the invention to the particular features mentioned in the summary or in the description. Rather, the scope of the invention is defined by the appended claims.

In certain embodiments, the disclosed embodiments may include one or more of the features described herein.

The term "portable" as used herein indicated a system that, like a standard flashlight, is wholly self-contained and can be moved around with minimal effort by a human. For example, some car headlamps rotate automatically in the direction of travel but this is not considered portable as it is not something that a person could carry conveniently and use quickly to light their work.

A new method for a flashlight adjusts the placement of the flashlight beam of light by the user with minimal physical contact with the flashlight and force on the part of the user.

A new flashlight assembly allows the user to adjust and readjust the direction of the light beam with minimal force such that the unit remains in its desired location as the adjustment is made and the adjustment can be made with only one hand and minimal force on the user's part.

These and further and other objects and features of the invention are apparent in the disclosure, which includes the above and ongoing written specification, with the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. The invention will be more particularly described in conjunction with the following drawings wherein.

LIST OF REFERENCE NUMERALS

Figures 1, 1A, 1B:
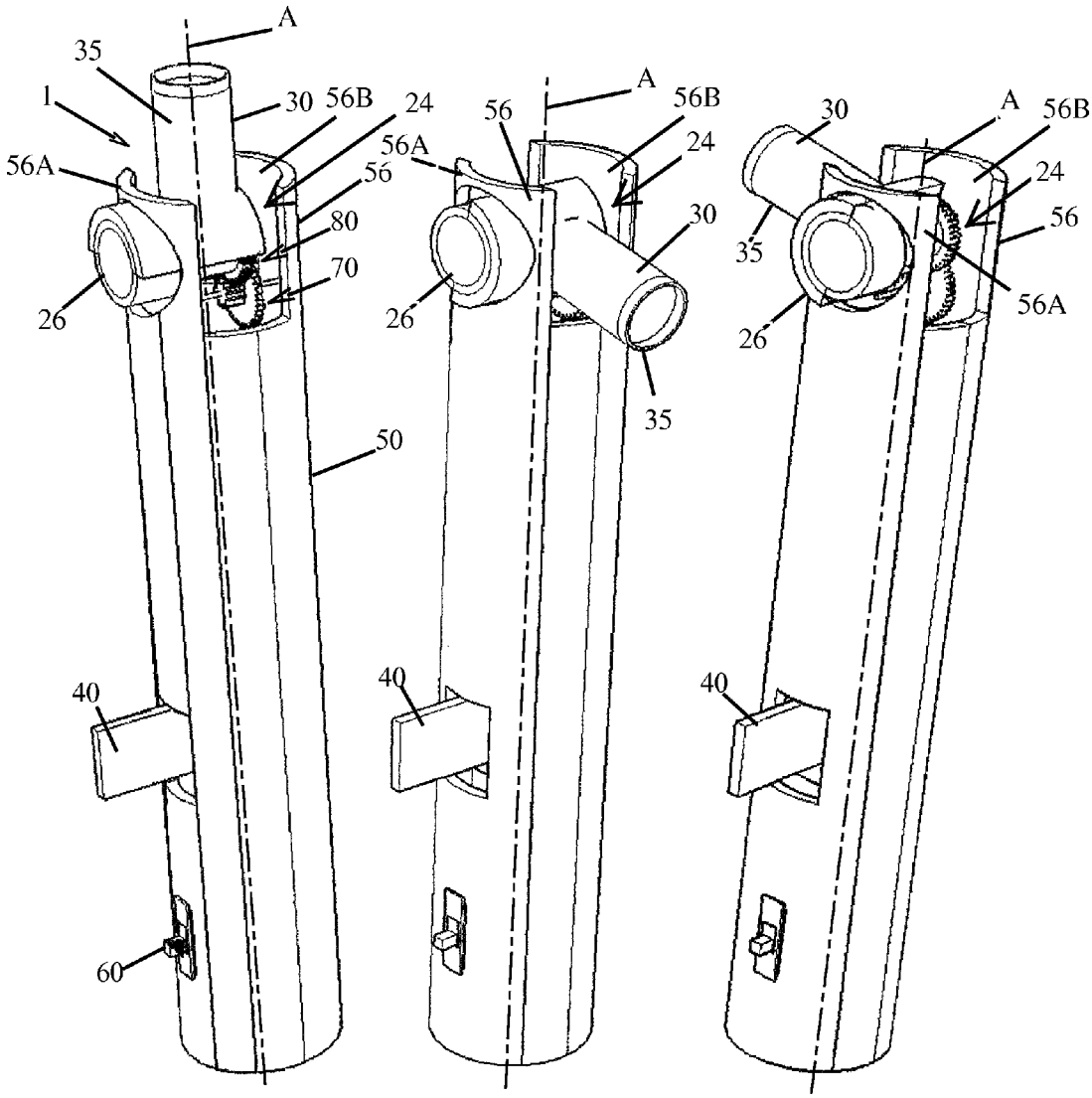
FIG. 1 is a perspective view of a flashlight.
FIG. 1A is a perspective view of a flashlight showing its head rotated in one direction.
FIG. 1B is a perspective view of a flashlight showing its head rotated in other direction.

30 Lighthead assembly
32 Lighthead assembly shaft

33 Rotating driveshaft fixed spur gear for lighthead
35 Lighting element compartment
35*a* Positive polarity wire
35*b* Negative polarity wire
40 Double pole double throw switch (DPDT)
41 Common terminal
42 Common terminal
49 Directional switch
50 Housing and bearing surface
51 Top of housing
52 Bottom of housing
52*a* Single pole single throw opening
52*b* Double pole double throw opening
52*c* Lighthead opening
53*a* Bottom spur gear spacer
53*b* Bottom spur gear spacer
53*c* Bottom spur gear spacer
53*g* Bottom crown gear spacer
55 Flat surface at base of light
60 Single pole single throw switch
61 Line side terminal
62 Load side terminal
69 User movable component
70 Gearbox/motor drive assembly
72 Mated spur gear
74 Mated spur gear
76 Mated spur gear
72*a* Large spur gear
74*a* Large spur gear
76*a* Large spur gear
72*b* Pinion spur gear
74*b* Pinion spur gear
76*b* Pinion spur gear
72*c* Mated spur gear shaft
74*c* Mated spur gear shaft
76*c* Mated spur gear shaft
78 Mated crown gear
71 Mated spur gear
79 Electric motor
75 Motor pinion spur gear
80 Clutch
82 Cylindrical piece fixed to spur gear rotating around drive shaft
84 Cylindrical piece for lighthead connection
82*a* Roughened surface of 82
84*a* Roughened surface of 84
85 Splined shaft
88 Coiled disk spring
90 Battery pack
91*a* Negative wire
92*a* Positive wire
100 Lighthead Sheave
101 Drive belt
102 Motor sheave
104 Bearing Surface

DETAILED DESCRIPTION

A flashlight with motorized directional lighthead for light-beam placement will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

Objects and advantages of the present invention include the ability to direct and redirect the beam of light with minimal force on the user's part. The prior art can redirect the beam of light via adjustment of the flashlight body or a portion of it but at a demand of significant force by the user. In many instances, both hands are required, especially if the unit is not secured to a firm surface. In all cases at least one hand and a secured support is required, as in the case of the Pelican 2250C unit, where care must be taken not to dislodge the unit from the head restraint as well as requiring one hand for the actual readjustment.

In the case of the DeWalt DW918 with the flexible neck, the user must use two hands. Despite the ability to self support the light head assembly in a fixed position, the actual adjustment requires two hands, one to secure the assembly as the head is adjusted and the other to actually adjust and reposition the head.

Flashlight embodiments with a motorized head allow many possibilities. Readjustment can be accomplished with one hand with the unit self supporting itself. Adjustment requires minimal force, thus allowing the unit to be left in place and directing of the beam of light to be made correctly on the first attempt. The possibility of displacing the unit from its desired location is drastically reduced due to the minimal force required to achieve the adjustment. Furthermore, the ability to use minimal force on the part of the user allows many variations for ease of use, such as remote control of the direction of the light beam via radio control or voice control.

Such flashlights are very useful for a mechanic, homeowner or tradesperson who needs to hold a tool, part, or other object in place with one hand while adjusting the beam direction with the other hand. Frequently, parts are dropped and a light has to be used to find the dropped part.

In one embodiment, the flashlight comprises five separate subassemblies. The first subassembly as shown in FIG. 1 is the Lighthead Assembly 30. This is a molded plastic assembly located in the Housing 50, which is another molded plastic assembly. Two user operated switches, the Double Pole Double Throw switch 40 and the Single Pole Single Throw switch 60, are located in the Housing 50. Protrusions through openings in the Housing 50 extend to a point where the user can access the switch function.

FIG. 1A shows the lighthead in one direction upon operation of the switches by the operator. FIG. 1B shows the Lighthead Assembly 30 in the other direction after operation of the user operated switches.

Referring to FIGS. 1, 1A, and 1B, the components of the flashlight 1 include an elongated housing or casing 50, a lighthead assembly 30, a motor 79, a mechanical linkage such as gearbox/motor drive assembly 70, one or more power sources such as batteries 20, and a user-operable control device such as switches 40, 60. The elongated housing 50 defines a lengthwise longitudinal axis A extending between its opposite ends 56, 57.

The lighthead assembly 30 is disposed at the one opposite end 56 of the housing 50 and mounted to undergo motion between the opposite sides of the one end 56, as best shown in FIGS. 1A and 1B, in opposite directions through the longitudinal axis A of the housing 50 such that a lighting element in compartment 35 of the lighthead assembly 30 is capable of emitting a light beam angularly directed to left (FIG. 1B) or right (FIG. 1A) of the longitudinal axis A or directed along (FIG. 1) the longitudinal axis A. More particularly, the lighthead assembly 30 is adapted to undergo motion up to about ninety degrees to the right or left from the longitudinal axis A.

The one end 56 of the housing 50 is bifurcated so as to define an end opening 24 between opposing portions 56A, 56B of the one end 56 that extends across the one end 56 in a transverse relationship to the longitudinal axis A and along opposite sides of the one end 56 being spaced in opposite directions from the longitudinal axis A. The lighthead assembly 30 is disposed in the end opening 24 of the housing 50 between the opposing end portions 56A, 56B of the bifurcated one end 56 of the housing 50 and mounted to undergo rotational movement about a rotational axis R extending between the opposing end portions 56A, 56B in transverse relationship to the longitudinal axis A. More particularly, the lighthead assembly 30 is rotatable in a clockwise direction or counterclockwise direction about the rotational axis R.

Furthermore, the lighthead assembly 30 has the lighting element compartment 35 and an axle 26 arranged across an end of the lighting element compartment 35. The housing 50 has bearing surfaces formed in the opposing end portions 56A, 56B of the bifurcated one end 56 of the housing that are adapted to rotatably support the axle 26 of the lighthead assembly 30.

The motor 79 is supported by the housing 50. The mechanical linkage 70 is configured to translate a motive force from the motor 79 into the motion of the lighthead assembly 30. The one or more power sources 20 are supported by the housing 50 and configured to supply power to the lighting element of the lighthead assembly 30 and to the motor 79. The user-operable control device 40 is configured to control the above-described motion of the lighthead assembly 30.

Figure 2:
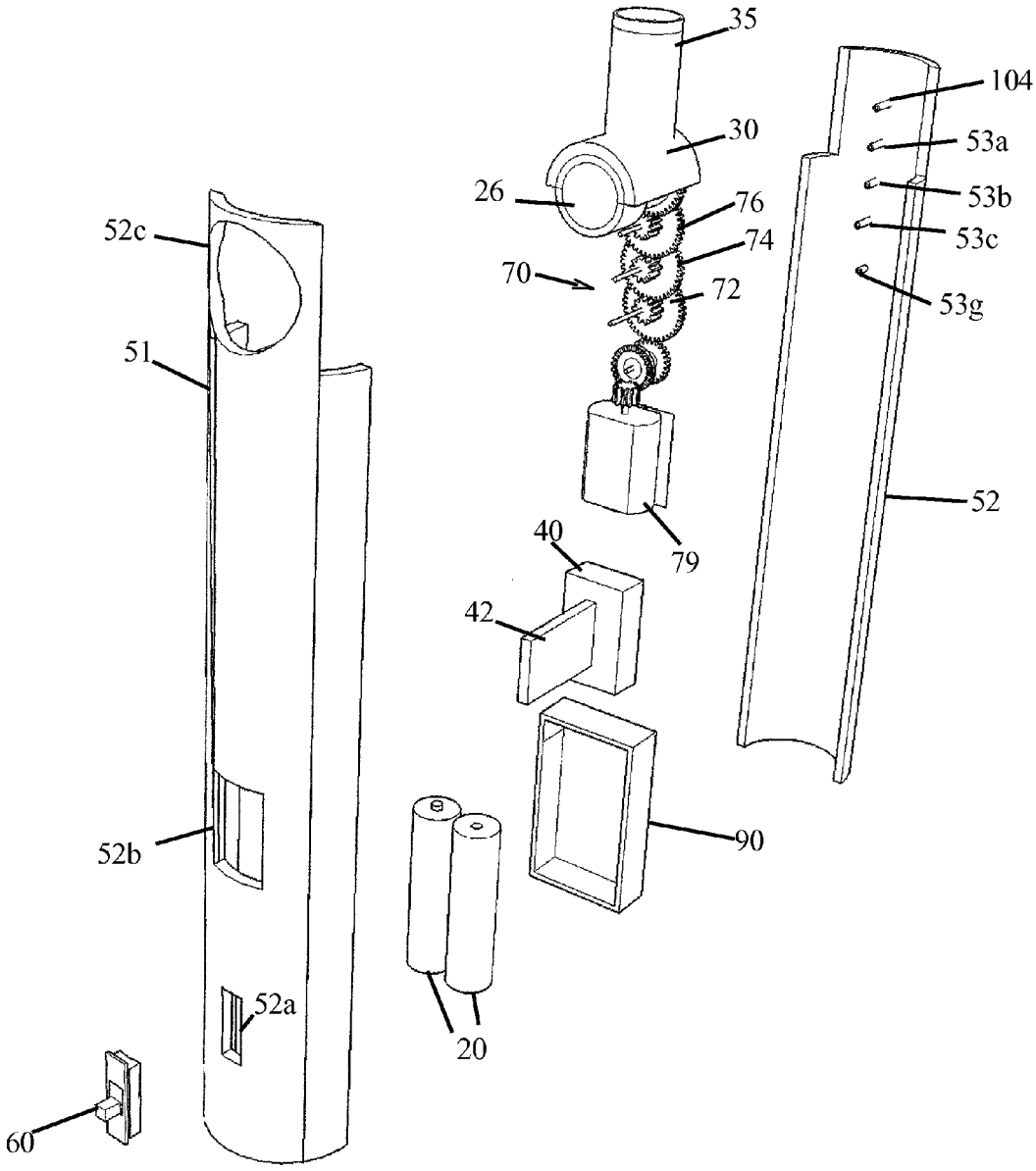
FIG. 2 is an exploded perspective view of a flashlight.

FIG. 2 is an exploded perspective view of the flashlight showing the major components of the flashlight. The Lighthead Assembly 30 is mounted on a shaft 32 that rotates on the housing 50 bearing surfaces 104. In this embodiment, the shaft is a steel component of sufficient size to properly align the attached components and resist bending and misalignment. The lighthead assembly 30 is a cylindrical structure to allow movement pivotally about a shaft. The assembly is a molded plastic assembly. The lighting element compartment 35 is a plastic cylindrical piece which protrudes from the front at a ninety degree angle to the rotation of the lighthead assembly 30 for containment of a lighting element. A standard clutch 80 is located in the annular space of the assembly.

The clutch 80 comprises two stacked molded plastic cylindrical pieces 82 and 84 with opposed end surfaces with a rough texture. In some embodiments, a plurality of ridgelike elements protrude from each of these end surfaces 82*a* and 84*a* and mate in a manner that locks them together when sufficient pressure is exerted. A coiled spring 88 maintains pressure yet allows independent movement should the forces exerted on the surfaces exceed the ability of the spring pressure to maintain rigid contact. The spring is made of metal, for example steel, and is of sufficient size to fit in the annular space of the clutch assembly.

Figure 2A:
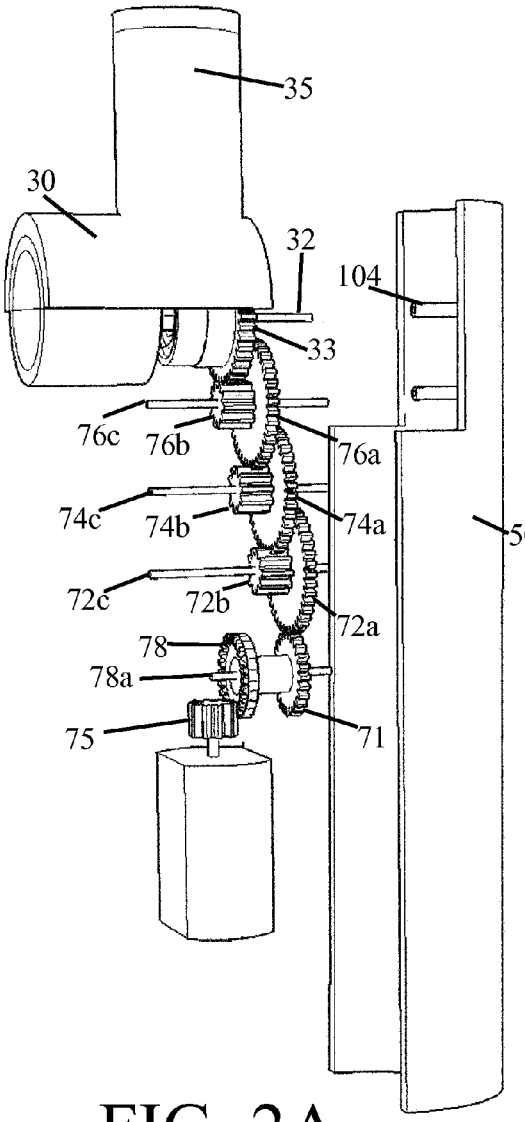
FIG. 2A is an enlarged exploded view of a drive assembly and lighthead assembly.

As shown in FIG. 2A, one of these cylindrical pieces 82 rotates around shaft 32 and is connected to the drive spur gear 33. The spur gear is constructed of plastic such as nylon. The other cylinder 84 is on a splined shaft which extends through its center and through the rough surface 84*a* and is connected to the cylindrical portion of the lighthead assembly 30. This surface 84*a* moves up and down the splined shaft and is connected to the shaft 32. The coiled spring 88 located coaxially around shaft 32 bears on a fixed surface of the lighthead assembly 30. The other end of the spring 88 bears on the cylinder 84, which forces the roughened surfaces 82*a* and 84*a* against each other via spring pressure to transmit torque of the drive assembly 70. The mated surfaces 82*a*, 84*a* mechanically connect the spur gear 33 to the rest of the lighthead assembly and transmits the torque from the drive assembly 70.

Figure 2B:
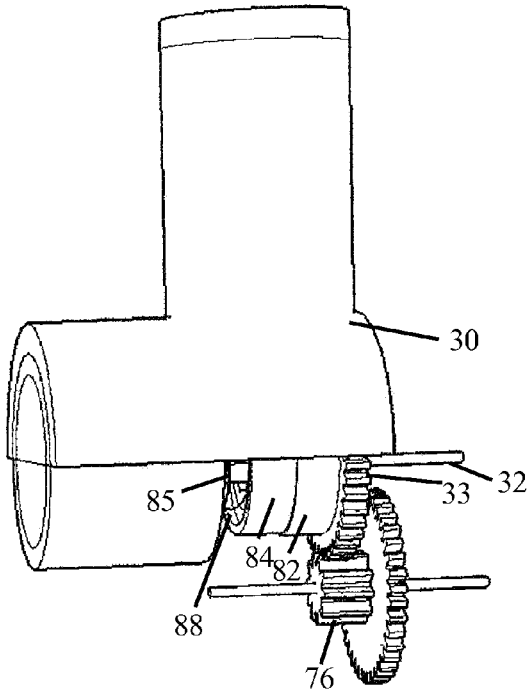
FIG. 2B is an enlarged exploded view of a lighthead assembly.

FIGS. 2, 2A, and 2B show the spur gear 33 located at the base of the light assembly 30 that rotates the assembly around the shaft 32 that is perpendicular to the longitudinal axis of the housing 50. The lighthead assembly 30 connects to the top of the clutch assembly 80 via the top of cylinder 84. The gear 33 rotates about shaft 32 and the Lighthead Assembly 30. The lighting element compartment 35 consists of a lighting element such as an incandescent bulb, LED or LED assembly located in an attached or molded portion which supports the lighting element. A clear plastic insert firmly closes the end of the compartment 35 and locates the lighting element within the annular space of the protrusion 35. A wire for positive polarity 35*a* connects the lighting element to a single pole single throw power switch 60. A wire for negative polarity 35*b* connects to the battery pack negative polarity terminal 91.

The drive assembly 70 in the illustrated embodiment consists of mated spur gears mounted on shafts driven by an electric motor. The spur gears in various embodiments are constructed of various suitable materials, for example plastics such as molded plastic like nylon or metals. Each mated spur gear 72, 74, 76 consists of a large spur gear 72*a*, 74*a*, 76*a* molded or otherwise fixed to a smaller pinion spur gear 72*b*, 74*b*, 76*b*. The gears are sized to provide the desired rotational speed of the lighthead assembly. Both gears share the same center and have an opening at this point for a shaft 72*c*, 74*c*, 76*c*. The shaft is made for example of steel of sufficient size to maintain alignment of the gear train relative to each gear and rigid enough to prevent misalignment.

The opening is of sufficient size to allow the mated spur gear 72, 74, 76 to rotate freely about the shafts 72*c*, 74*c*, 76*c*. The shafts 72*c*, 74*c*, 76*c* of the gears bear on the housing 50 via a plastic support plate. A molded plastic spacer 53*a*, 53*b*, 53*c* protruding from the housing places each gear in the drivetrain in proper orientation relative to the preceding gear and the subsequent gear in the train. The pinion spur gear 76*b* meshes with lighthead drive gear 33. The lighthead drive gear 33 is the gear at the base of the lighthead assembly which meshes with the other gears in the gear train and ultimately turns the lighthead assembly. The gear transmits power up through the clutch assembly and turns the lighthead assembly. The mated spur gear 76*a* meshes with preceding pinion spur gear 74*b*. The mated spur gear 74*a* meshes with pinion spur gear 72*b*. The large spur gear 72*a* of mated spur gear 72 meshes with further gearing as described below.

The further molded plastic supports connected to the top of the housing insure the gears stay in alignment. A mated crown gear 78 and spur gear 71 assembly precedes the final mated spur gear 72. The assembly is mounted on a steel shaft 78*a* which bears on the housing 50. The mated crown gear 78 and spur gear 71 are fixed to shaft 78*a* which passes through the center of the two gears. Large spur gear 72*a* meshes with spur gear 71. An electric motor 79 is mounted on a plastic support structure molded to the housing. The support structure is of sufficient size to support the electric motor 79 in a position to maintain alignment of a motor pinion spur gear 75 mounted on the discharge shaft meshing with the crown gear 78. This support can be molded in or screwed to the housing.

The pinion spur gear 75 mounted on the motor shaft meshes with a crown gear 78 which is attached to the first mated spur gear 72 of the drive assembly train. This gear meshes with adjacent gears through the gear train. The final gear of the drive assembly meshes with the gear attached to the Lighthead Assembly. The electric motor 79 has wires connected to each terminal. These wires lead to the Double Pole Double Throw switching mechanism 40.

Figure 4:
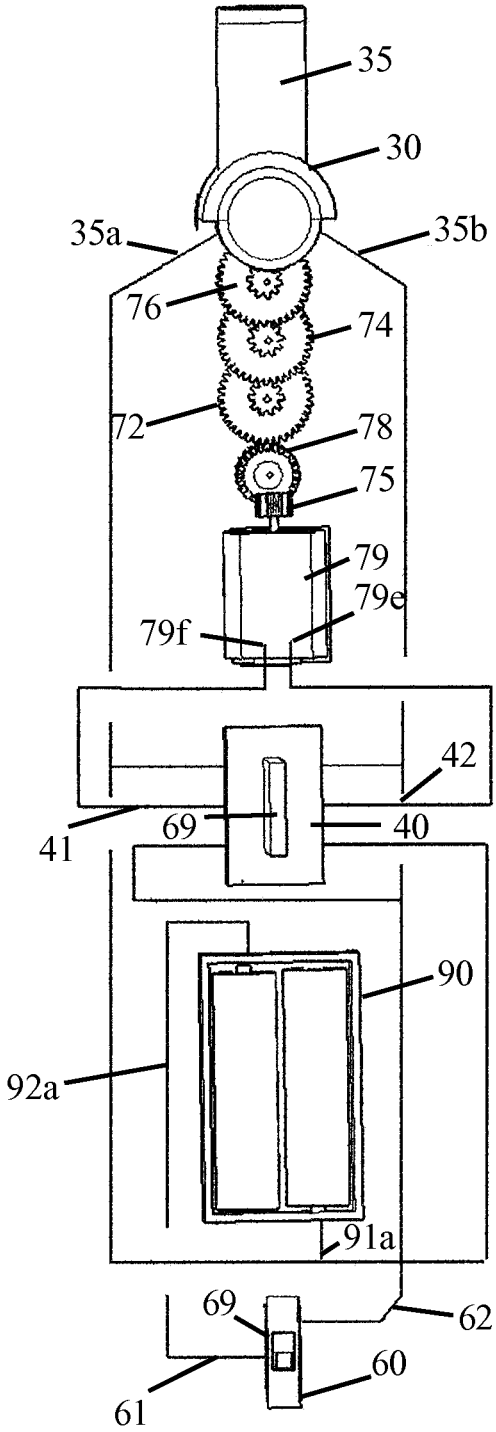
FIG. 4 is a wiring diagram of a flashlight unit.

FIG. 4 shows the electrical components of the flashlight and the interconnection of the components. FIG. 2 continues to show the relative placement of the components. The Double Pole Double Throw switching mechanism 40 is located in the Housing 50 of the flashlight. Wires from each terminal of the motor connect to each of the common terminals 41, 42 located in the center of the Double Pole Double Throw assembly 40.

The terminals on the two poles have wires leading from the terminals. Each set of terminals has a positive polarity wire and a negative polarity wire. The wires connected to the negative polarity terminal of each pole of the switch 40 are connected to the negative polarity pole of the battery pack assembly 90. The wires connected to the positive polarity terminal of each pole are connected to a single pole single throw switch 60 load side terminal 62 mounted in the housing 50. The wires jointly connects with the wire 35*a* from the Lighthead Assembly 50.

This switch 60 connects and disconnects power from the battery pack 90 to both the drive assembly motor 79 and the lighting element of the Lighthead Assembly 30. The plastic directional lever 49 protrudes from the top of the switch assembly and is a straight piece of material mounted on a shaft. The directional lever activates the DPDT switch so that the user can push the lever one way or another and the lighthead will rotate in the direction that the lever is pushed. The directional lever is of sufficient size to force the internal contacts in the DPDT switch together for the appropriate direction and allow the user to control the direction of the lighthead assembly via one finger.

The plastic battery pack 90 is mounted to or molded into the housing assembly 50. The battery pack in this embodiment is a rectangular box structure of sufficient size with a depression in the center of sufficient size to accommodate standard batteries. Each end of the battery pack has metal terminals. Batteries of various sizes are located in the battery pack assembly. The batteries can be rechargeable or disposable batteries. The batteries are located in series in the battery pack assembly.

The positive terminal consists of an electrically conductive spring plate in direct contact with the positive terminal of the first battery to the wiring lead 92*a* to the single pole single throw switch 60 line side terminal 61. The negative end of this battery is electrically connected to the positive end of the other battery via a conductive plate located at one end of the battery pack. The negative end of the second battery is adjacent to and in contact with the negative terminal 91 of the battery pack. The terminal is a steel or copper spring plate or other suitable construction. This terminal is connected to a wire 91*a*. The wire 91*a* splits and connects to the wires from the negative poles of the double pole double throw switch assembly 40 and the wire 35*b* from the negative pole of the lighting element in the Lighthead Assembly 30.

The molded plastic housing is split in half, consisting of a top housing section 51 and a bottom housing section 52. It is of sufficient length and volume to contain the subassemblies of the flashlight. It is either a molded or built up assembly from plastic components. The shape of the casing can be cylindrical or rectangular, thus providing more flat surfaces for flashlight placement. The lower housing section 52 contains the mounted subassemblies previously described and is used as a bearing surface for the shafts of the gears of the drive assembly 72*c*, 74*c*, 76*c*, the shaft 32 of the gear for the Lighthead Assembly and the shaft 78*a* for the mated crown gear and spur gear. The lower housing supports battery pack 90, the motor support and Double Pole Double Throw switch assembly 40.

The top section 52 of the housing has an opening in the perimeter of the housing. The first opening 52*a* provides space for the Single Pole Single Throw switch 60 to be mounted on its surface. The user movable component 69 of the switch protrudes from the surface of the Top section 51 of the housing. The movable component moves longitudinally along the housing 50. The next opening 52*b* provides space for the user operated Double Pole Double Throw switch 40 to protrude from the opening. The opening is of sufficient size to allow free movement of the switch in either direction to the full extent of the directional switch 49 range of travel. The directional switch 49 moves across the longitudinal axis of the housing in a manner reflecting the user intended direction of the Lighthead Assembly 30. The Top Section of the Housing serves as a Bearing surface for the circumferential surface of the Lighthead Assembly 30.

OPERATION AND INVENTION

In certain embodiments, the flashlight assembly operates via two user operated switches. These switches allow the user to operate the unit with one hand and minimal force while it rests on any convenient surface or in the user's hand. The same hand supporting the light can direct the beam, thus eliminating the need for a second hand.

The user initiates the unit operation by using the Single Pole Single Throw Switch 60 to the power position by pushing it forward. The switch provides power from the battery pack 90 to the entire flashlight assembly including the directional drive train 70 and the lighthead assembly 30.

At this stage the flashlight is providing light via the Lighthead Assembly 30. The lighting element has power from the Battery Pack to cause it to provide illumination for the user's purposes.

The user operates Double Pole Double Throw switch 40 to provide direction to the Lighthead Assembly 30. The Lighthead Assembly could be at any angle to the longitudinal direction of the flashlight housing 50, thus requiring the user to adjust the angle of the Lighthead Assembly 30 to the optimal direction. The user via their thumb or other single finger shifts the directional lever 49 which protrudes from the housing 50.

The directional lever 49 mirrors the direction of the Lighthead Assembly 30 rotation. If the user wants to direct the Lighthead Assembly 30 to the left side of the housing 50, the directional lever 49 is shifted to the left. This provides power from the battery pack 90 to the motor 79, which transmits the torque through the drive assembly 70 to the Lighthead Assembly 30, rotating it to the left. The user leaves the directional lever 49 in this position until the desired angle is achieved for the Lighthead Assembly 30 and thus the beam of light provided by the lighting element. Once the desired angle is achieved the user releases the lever 49.

The user likewise can shift the directional lever 49 to the right causing the Lighthead Assembly to rotate to the right as per the user requirements.

The unit can be stood on the end of the housing 50 opposite the lighthead assembly to allow the user to work with both hands and make adjustments with minimal force, e.g. one finger as per the above description to locate light as per the user's needs. In addition, the flashlight assembly can be held with one hand as the user works with the other hand. The user can adjust the Lighthead Assembly 30 with one finger on the directional lever 49 to move the Lighthead Assembly 30 and thus the light beam to the desired direction with minimal interruption to the user's work process.

Figure 3:
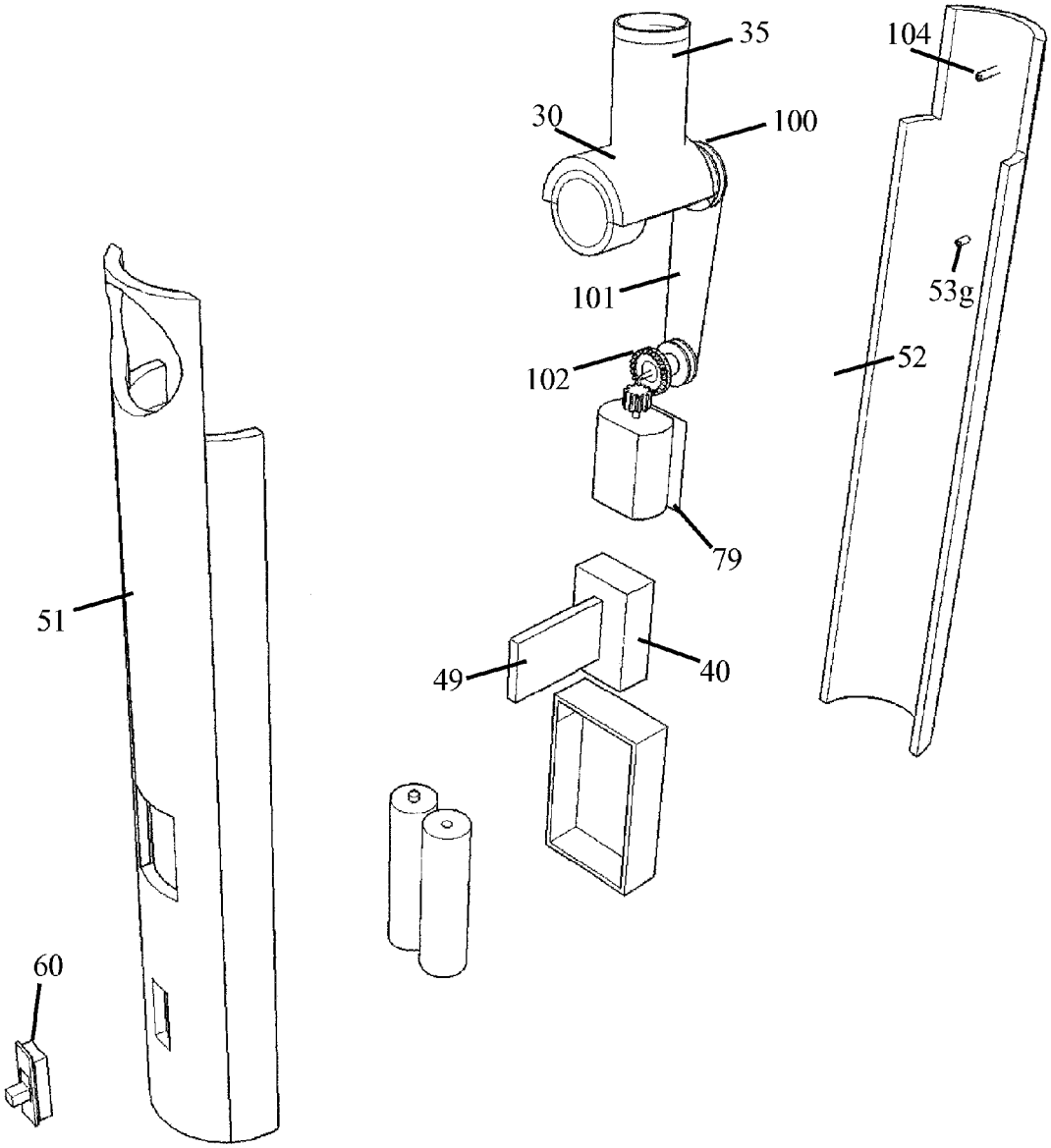
FIG. 3 is a belt driven lighthead assembly.

FIG. 3 shows a belt driven lighthead assembly. In this embodiment the flashlight consists of a housing 50 with a lighthead assembly 30. At the base of the lighthead assembly a sheave 100 connects to the Lighthead assembly shaft 32. The sheave has a belt 101 contained within the perimeter annular space. The belt 101 is sufficient in size to extend back to another sheave 102. The sheave is fixed to a shaft mounted at the base of a mated crown gear. The crown gear interfaces with the motor pinion.

The Single Pole Single Throw Switch located in the housing provides power to both the lighting element and the motor via the Double Pole Double Throw switch for directing the lighthead assembly. The Double Pole Double Throw switch located in the housing controls power to the motor to direct the rotation of the Lighthead Assembly. The user moves the switch to the power position. This sends power to the lighting element located in the Lighthead Assembly. The power goes to the Double Pole Double Throw switch, which the user operates to direct power to the motor. The motor turns the connected motor pinion which meshes with the crown gear. The crown gear is fixed on the same shaft as the sheave 102 is affixed to. The motor rotates the sheave, which rotates the belt 101 which rotates the sheave 100. This sheave is connected to the Lighthead assembly causing the Lighthead Assembly to rotate in the direction desired by the user as directed via the Double Pole Double Throw Switch.

ADVANTAGES

The flashlight of the various disclosed embodiments is an extremely useful device that improves the industry and safety of any person using it in the course of their work.

While the above description contains many specificities, these should not be construed as limitations of the scope of the invention, but rather as an exemplification of one embodiment thereof. Many other variations are possible. For example, the unit could be controlled in various manners beyond the manual switches. The unit in some embodiments is voice controlled or remotely controlled via radio transmissions. The unit in one embodiment follows a transponder mounted to the user's hand, thus positioning the unit beam to in the most advantageous position for the user.

The lighthead in one embodiment is mounted on a ball mechanism to allow the rotation of the lighthead in multiple axes as per the user direction. In one embodiment the lighthead is mounted on a crank arm. Linkages connect from a similar but opposed crankhead mounted on the motor end of the drivetrain. The linkages connect to each end of the of the crank arm and push and pull the lighthead in the direction desired by the user.

The drivetrain in some embodiments uses helical gears for quieter operation. The gears in some embodiments are metal rather than plastic for greater durability in more rigorous environments. Likewise, in some embodiments the housing and lighthead assembly are made of metal for improved durability. In one embodiment the housing is made of fiberglass instead of plastic.

For increased durability, in some embodiments the lighthead assembly is completely enclosed in the flashlight housing. Alternative switch types built around commercially available SPST switches built up to mimic a DPDT switch replace the custom built DPDT switch for directional control in some embodiments. This allows for a more reliable life span of the switches given the lifecycle standards incorporated into SPST switch construction and engineering. An aesthetic cover and appropriate wiring in some embodiments help the unit mimic the DPDT function.

In some embodiments, the unit is scaled to make it larger, which is done relatively easily. This allows for a larger lighthead and more light. In some embodiments, the lighthead moves in two different axes in two directions. In some embodiments, the whole assembly is scaled down for a smaller and lighter unit. Downscaling is only limited by the size of standard batteries and the tradeoff between lifetime of battery and the light output.

The gears in some embodiments are different sizes to allow for a different gear ratio and speed of the lighthead. Individual gears are changed in some embodiments to allow for a lower profile gear train by alternating the relative heights of the meshing gears instead of a stepped arrangement. Some embodiments have different sized lightheads to allow for more illuminating elements and thus more light output.

In some embodiments the switches are made in various sizes and styles to accommodate the tasks desired by the user. A rocker switch is used in some embodiments for the directional lever instead of a straight lever. In some embodiments the two switches are combined into a single unit that both controls power and direction of the lighthead.

In some embodiments, the unit is built in a modular manner. The base unit includes the lighthead assembly, the switches, the housing and the internal gear train and battery pack. Modules are attached to the end opposite the lighthead assembly. These modules in certain embodiments add the ability for the lighthead to achieve various control methods such as voice or radio control. In some embodiments legs are included in a module to make the unit more stable when standing upright. In some embodiments a module allows different means of attachment to various structures, ie magnetic, vacuum or friction.

The switching assembly in various embodiments uses various types of switches. A DPDT switch is able to reverse the motor and direction of movement of the lighthead assembly. The DPDT switch in one embodiment has two poles and two throws and in one embodiment is built up from four SPST switches. In one embodiment, two simple copper strips create a voltage imbalance which drives the motor in the desired direction. Both of these types of switches could utilize two separate buttons on the casing. One button would be for clockwise direction. It would push the appropriate copper strip or pair of SPST switches to direct the motor. The other switch would be for counterclockwise and would push the other copper strip or SPST switch pair to direct the motor in the opposite direction and ultimately the lighthead.

There are a variety of ways to transmit rotational energy from the power to the lighthead assembly. Gears are used in one embodiment, a belt drive in one embodiment, and a series of friction wheels in one embodiment. A chain drive is used in one embodiment, but is heavy for the task. In one embodiment, a computer controlled motor like a servo controls the light without the need for something to reduce motor speed enough to turn the lighthead assembly at a speed appropriate for a user to rely on visual feedback to control the direction of the light. Any of these methods is considered a mechanical linkage.

The scope of the invention should be determined not by the embodiments illustrated, but by the appended claims and their legal equivalents.

Certain embodiments include:

1. A portable illuminating device with a powered pivotable lighthead assembly where
   a. the powered pivotable lighthead assembly using a power transmission means to direct said lighthead assembly, and
   b. the power transmission means being directed by means of a user controlled switching assembly.
2. The portable illuminating device of 1 where the pivotable lighthead assembly contains a lighting element.
3. The portable illuminating of 1 where the pivotable lighthead assembly contains a drive gear attached to the bottom of the assembly.
4. The portable illuminating device of 2 where the lighting element is a plurality of light emitting diodes.
5. The portable illuminating device of 1 where the power transmission means comprises a plurality of rotary power transmission elements.
6. The portable illuminating device of 5 where the plurality of power transmissions elements includes a set of interlocking gears of predetermined diameters.
7. The portable illuminating device of 1 where the power transmission means includes a motor with a pinion gear on the discharge shaft.
8. The portable illuminating device of 7 where the motor is electrically powered.
9. The portable illuminating device of 1 where the interlocking gears mate with the drive gear of the lighthead assembly.
10. The portable illuminating device of 1 where the user controlled switching assembly includes an electrical switching assembly.
11. The portable illuminating device of 10 where the electrical switching assembly is a double pole double throw switch for the user to direct the light.
12. The portable illuminating device of 1 further including a casing with surface contours to provide stable placement for the operation of the light.
13. The portable illuminating device of 1 further including a clutch assembly at the base of the pivotable lighthead assembly.
14. A method of providing portable artificial light including providing a pivotable lighthead assembly which shines light in the needed direction, providing a power transmissions means for rotating the lighthead assembly to the desired direction, and providing a user controlled switching assembly which the user controls said power transmission means to rotate the lighthead assembly.
15. The method of 14 wherein the pivotable lighthead assembly has a driven gear attached at the base.
16. The method of 14 where the pivotable lighthead assembly includes a multitude of light emitting diodes.
17. The method of 14 where the power transmission means includes interlocking gears mating with the driven gear of the lighthead assembly.
18. The method of 13 where the user controlled switching assembly is a double pole double throw switch providing user direction to the power transmission means.
19. A portable device for illumination including a lighthead assembly which pivots, a power transmission for rotating the lighthead assembly and a switch controlled by the user whereby the user directs the light beam with minimal effort to the desired direction.
20. The portable device for illumination of 19 where the power transmission means utilizes a gear box to provide turning action to the lighthead assembly.
21. The portable illuminating device for illumination of 19 where the switch controlled by the user is a double pole double throw switch connected to a user interface to allow the user to turn the lighthead assembly via the power transmission means to the desired direction.
22. A method of placing portable light exactly where the user needs with minimal effort.

The invention is not limited to the particular embodiments illustrated in the drawings and described above in detail. Those skilled in the art will recognize that other arrangements could be devised, for example, various casing shapes, switch arrangements, and drive mechanisms. The invention encompasses every possible combination of the various features of each embodiment disclosed. While the invention has been described with reference to specific illustrative embodiments, modifications and variations of the invention may be constructed without departing from the scope of the invention.

I claim:

1. An apparatus, comprising:

a housing defining a lengthwise longitudinal axis extending between opposite ends of the housing;

a lighthead disposed at the one end of the housing and mounted to undergo motion in opposite directions through the longitudinal axis of the housing such that the lighthead is capable of emitting a light beam angularly directed to either the left or right of longitudinal axis or directed along the longitudinal axis;

a motor supported by the housing;

a mechanical linkage configured to translate a motive force from the motor into the motion of the lighthead;

one or more power sources supported by the housing and configured to supply power to the lighthead and to the motor; and a user-operable control device configured to control the motion of the lighthead.

2. The apparatus of claim 1, further comprising a lighting element within or attached to the lighthead for emitting the light beam.

3. The apparatus of claim 1, wherein one of the user-operable control device or a second control device controls the supply of power to the lighthead.

4. The apparatus of claim 1, wherein the lighthead is adapted to undergo motion up to about ninety degrees to the right or left from the longitudinal axis.

5. The apparatus of claim 1, wherein the user-operable control device comprises a switching assembly in the form of a bi-directional switch that when operated causes the lighthead to rotate in a clockwise or counterclockwise direction about a rotational axis.

6. The apparatus of claim 1, wherein the one end of the housing is bifurcated so as to define an end opening between opposing portions of the one end of the housing extending across the one end in a transverse relationship to the longitudinal axis and along opposite sides of the one end being spaced in opposite directions from the longitudinal axis.

7. The apparatus of claim 6, wherein the lighthead is disposed in the end opening of the housing between the opposing end portions of the bifurcated one end of the housing and mounted to undergo rotational movement about a rotational axis extending between the opposing end portions in transverse relationship to the longitudinal axis.

8. The apparatus of claim 6, wherein the lighthead is rotatable in a clockwise direction or counterclockwise direction about a rotational axis extending in a transverse relationship to the longitudinal axis.

9. The apparatus of claim 6, wherein the lighthead has a lighting portion and an axle portion arranged across an end of the lighting portion.

10. The apparatus of claim 9, wherein the housing has bearing surfaces formed in the opposing end portions of the bifurcated one end of the housing adapted to rotatably support the axle portion of the lighthead.

11. The apparatus of claim 8, wherein the housing has an elongated body adapted for carrying the housing in a person's hand.

12. The apparatus of claim 1, wherein the user-operable control device comprises a remote control device.

13. The apparatus of claim 1, wherein the user-operable control device comprises a voice control device.

14. The apparatus of claim 1, wherein the housing has a hollow interior defining a cavity housing the motor, one or more power sources, user-operable control device, mechanical linkage, and lighthead.

15. The apparatus of claim 1, wherein the mechanical linkage comprises a drive gear.

16. The apparatus of claim 1, wherein the mechanical linkage comprises a plurality of rotary power transmission elements.

17. The apparatus of claim 16, wherein the plurality of rotary power transmission elements comprises a set of interlocking gears of predetermined diameters.

18. The apparatus of claim 1, wherein the motor comprises a discharge shaft and the mechanical linkage comprises a pinion gear on the discharge shaft.

19. The apparatus of claim 17, wherein the interlocking gears mate with a drive gear of the mechanical linkage.

20. The apparatus of claim 1, wherein the housing comprises flat surface contours distributed around the circumference of the housing, allowing for stable placement of the housing on a flat surface for the operation of the lighthead.

21. The apparatus of claim 1, wherein the mechanical linkage comprises a clutch assembly directly connected to the lighthead.

22. The apparatus of claim 1, wherein the mechanical linkage comprises a gear box to provide the motion in the form of a turning of the lighthead.

23. A method of operating the apparatus of claim 1, comprising operating the user-operable control device, causing the lighthead to rotate and change the direction of the emitted light beam.

24. The apparatus of claim 1, wherein the user-operable control device comprises a switching assembly being movable in a given direction to cause movement of the lighthead in the same direction.

* * * * *